US007665717B2

(12) United States Patent
Lenzini

(10) Patent No.: US 7,665,717 B2
(45) Date of Patent: Feb. 23, 2010

(54) VACUUM HOLD-DOWN

(76) Inventor: Martin John Lenzini, Nevada, Thetford Road, Coney Weston, Bury St. Edmunds, IP31 1DN (GB)

( * ) Notice: Subject to any disclaimer, the term of this patent is extended or adjusted under 35 U.S.C. 154(b) by 225 days.

(21) Appl. No.: 10/595,041

(22) PCT Filed: Apr. 23, 2004

(86) PCT No.: PCT/GB2004/001728

§ 371 (c)(1),
(2), (4) Date: Jan. 11, 2006

(87) PCT Pub. No.: WO2005/014229

PCT Pub. Date: Feb. 17, 2005

(65) Prior Publication Data

US 2006/0157905 A1 Jul. 20, 2006

(30) Foreign Application Priority Data

Jul. 11, 2003 (GB) ..... 0316280.7
Mar. 26, 2004 (GB) ..... 0406758.3

(51) Int. Cl.
*B25B 11/00* (2006.01)

(52) U.S. Cl. ..... 269/21; 269/20; 269/289 R

(58) Field of Classification Search ..... 269/21, 269/20, 210, 291, 289 R, 302.1; 409/219; 294/62.2

See application file for complete search history.

(56) References Cited

U.S. PATENT DOCUMENTS

| | | | | |
|---|---|---|---|---|
| 5,775,395 | A * | 7/1998 | Wilkins | 144/286.5 |
| 6,513,802 | B2 * | 2/2003 | Seger | 269/21 |
| 6,857,444 | B2 * | 2/2005 | Davis | 137/115.06 |
| 2006/0157905 | A1 * | 7/2006 | Lenzini | 269/21 |

FOREIGN PATENT DOCUMENTS

| | | |
|---|---|---|
| FR | 2546790 | 12/1984 |
| WO | WO 9210336 | 6/1992 |

* cited by examiner

*Primary Examiner*—Lee D Wilson
(74) *Attorney, Agent, or Firm*—Brooks Kushman P.C.

(57) ABSTRACT

A vacuum hold-down device comprising a base member (1) and a separate workpiece support (8) which co-operate to define a vacuum chamber. The device further comprises a venturi (15) having an inlet port (7) for connection to a source of pressurized fluid, an outlet (9) for fluid from the venturi, and a fluid connection (19, 5) from a low pressure region of the venturi (15) to the inside of the vacuum chamber, for providing a partial vacuum therein. The partial vacuum will hold the base member (1) and the workpiece support (8) together to maintain a peripheral seal therebetween. The workpiece support (8) is provided with securing means (16) for securing a workpiece (10) thereon. The invention also provides a vacuum hold-down system comprising the base member (1) and a plurality of interchangeable workpiece supports (8).

28 Claims, 12 Drawing Sheets

VACUUM HOLD-DOWN

BACKGROUND OF THE INVENTION

1. Field of the Invention

The present invention relates to a vacuum hold-down device for holding a workpiece or component for machining.

2. Description of the Prior Art

Vacuum devices for holding work objects have been known for some time. DE 4221222 describes a vacuum hold-down device comprising a base plate with suction openings connected to a vacuum system. A top plate on which work objects are laid has vertical holes from the underside right through to the upper surface and there is a seal surrounding these holes under the underside and another similar seal on the top surface. The holes in the base plate not overlain by the top plate are closed with stoppers, and the base plate is provided with threaded bushes for fixing clips. The device is complex to construct, and few small workshops have suitable vacuum lines for connection to the suction openings.

Also known are systems which employ pistons to create a partial vacuum to hold a workpiece, as described in U.S. Pat. No. 5,626,378, U.S. Pat. No. 4,470,585, GB 1,588,012, GB 2 120 141, DE 42 15 140, and SU 1079373. The pistons act on a deformable material, for example a flexible membrane or a suction cup, which in turn subjects the workpiece to a partial vacuum. In another application, FR 2 262 751 describes the use of a piston to clamp a workpiece to marble. The use of pistons, and means to return the pistons to a rest position adds to cost and manufacturing complexity. Moreover, flexible suction cups or membranes do not work well with steel workpieces; swarf associated with the machining process rapidly causes damage to the flexible material of the membrane or suction cup.

FR 2 546 790 discloses a vacuum hold-down device which comprises a sealed box which can be evacuated by a venturi and which has holes in its top which are fitted with retractable seals for forming a seal between the upper surface and an object to be held. The box is obtained either my manufacturing by removing shavings or by moulding. The waterproof assembly of its elements or parts is effected by using thixotropic products on the sealing parts. The device requires significant downtime when parts which have been machined must be removed and replaced.

The present invention seeks to reduce at least some of the problems of the prior art devices.

SUMMARY OF THE INVENTION

According to an aspect of the present invention there is provided a vacuum hold-down device comprising a base member and a separate workpiece support which co-operate to define a vacuum chamber, and a venturi having an inlet port for connection to a source of pressurized fluid, an outlet for fluid from the venturi, and a fluid connection from a low pressure region of the venturi to the inside of the vacuum chamber, for providing a partial vacuum therein, which partial vacuum will hold the base member and the workpiece support together to maintain a peripheral seal therebetween; wherein the workpiece support is provided with securing means for securing a workpiece thereon.

Because the base member and the workpiece support are held together by the vacuum, they may be readily separated when not under vacuum to enable the workpiece support to be removed and quickly replaced by another workpiece support, thereby minimizing machine downtime. The workpiece support may be quickly removed after momentary release of the vacuum. This may readily be achieved either by turning off the pressurized fluid flow or by opening a vent to connect the vacuum chamber to the atmosphere, for example a stop-cock located at the low pressure region of the venturi.

In a preferred embodiment, the base member and the workpiece support are plates or are of plate-like construction. The invention will for convenience be described herein with reference to the use of a base plate and a work plate, but it will be understood that the invention is not limited by the shape of the base member or the workpiece support.

By providing a venturi connection to the chamber the device may be operated by connecting the inlet port to a suitable pressurized fluid source, for example compressed air, which is typically available in a machining environment. Compressed air is preferred because it is readily available and clean, however other pressurized fluids could also be used, for example pressurized water, or coolant from the machine.

In a preferred embodiment the securing means comprises clamping means on an external surface of the work plate (the work surface) for releasably clamping one or more workpieces which are to be machined. There may be a plurality of work plates, each of which may be made ready by having one or more workpieces clamped to it. After the first work plate has been secured to the base member by means of the applied vacuum, and the workpiece or pieces have been machined, the first work plate may be quickly removed after momentary release of the vacuum, to be replaced by a new work plate with new workpieces for machining. Because the second work plate may be loaded with workpieces while workpieces on the first work plate are being machined this arrangement minimises machine downtime.

In another embodiment, the securing means comprises a plurality of holes in the work plate, which provide fluid communication between the inside of the vacuum chamber and the work surface of the work plate. The holes provide vacuum hold-down of the workpiece. They may comprise the sole means for securing the workpiece or pieces, or additional clamping means, for example mechanical clamps, may be provided.

On larger base plates the partial vacuum in the vacuum chamber may be applied through holes in the base plate to aid clamping of the device to a machine table on which the machining operation is to take place. This may help to reduce vibration and is of particular use for machining a component secured near the centre of a plate or in areas inaccessible to conventional clamping.

Where a magnetic machine chuck is to be used, the base plate may be made from a ferrous metal, for example steel, so that it is held firmly by the magnetic chuck.

The venturi could be provided separately from the base plate. However for convenience and simplicity, it is preferred that the venturi is provided at least partly within a housing associated with the base plate. Preferably, the venturi is housed substantially within the area of the base plate.

The vacuum chamber is defined between inner surfaces of the base plate and the work plate, and is preferably of quite small depth relative to its breadth and width to keep the vacuum volume small. Preferably the depth is the range 0.05 to 0.5 mm, notably 0.1 to 0.2 mm. It is preferred that the depth is provided substantially or entirely by a recessed region in the upper surface of the base plate, but some or all of the depth could also be provided by a recess in the work plate.

In a preferred embodiment, the invention provides a vacuum workholding system having a common base plate and a plurality of work plates. Each work plate may be of identical design, or some or all of the work plates may be different for machining different components.

Other aspects and benefits of the invention will appear in the following specification, drawings and claims.

BRIEF DESCRIPTION OF THE DRAWINGS

The invention will now be further described, by way of example, with reference to the following drawings in which.

DETAILED DESCRIPTION

Figure 1:
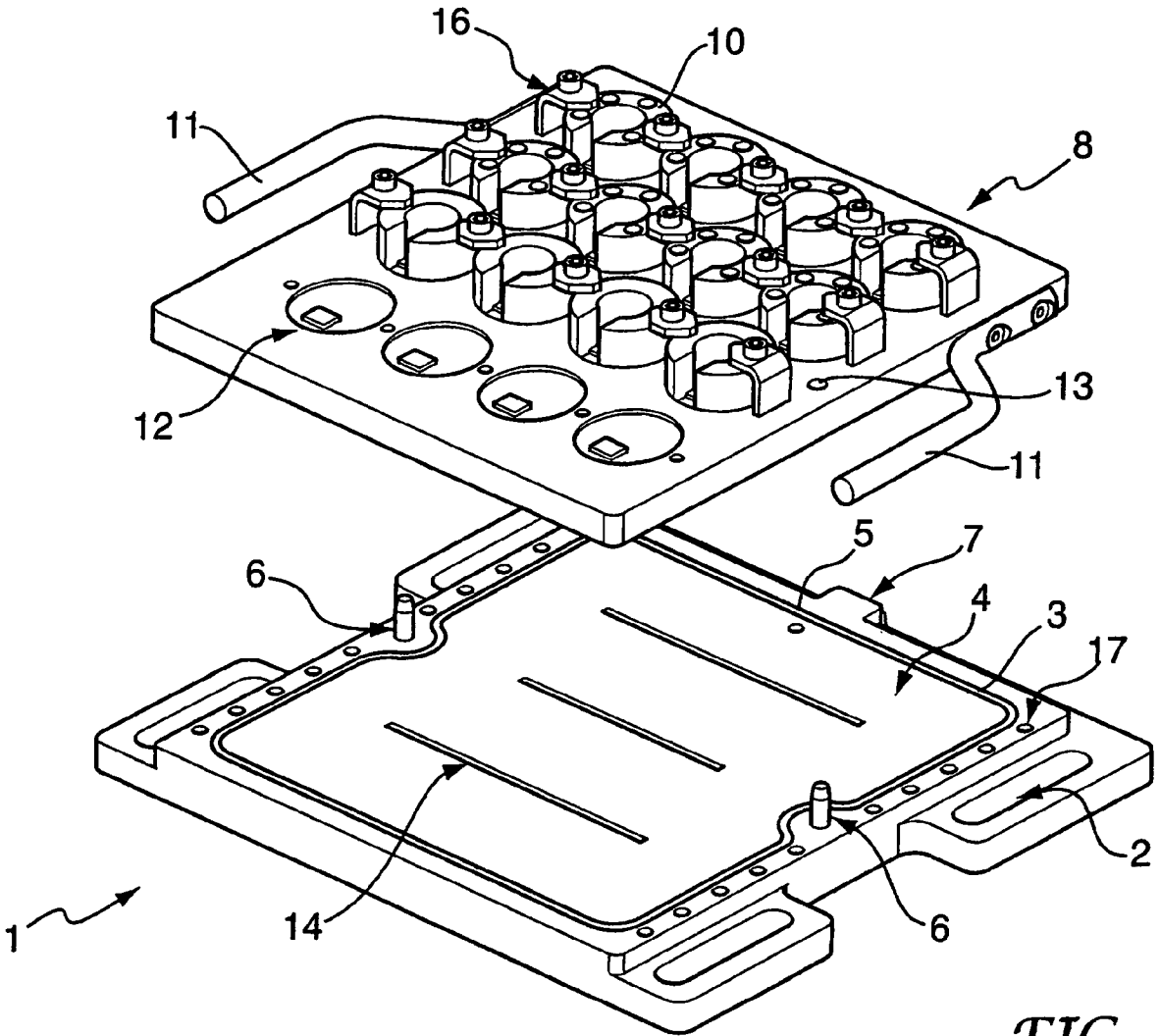
FIG. 1 is a view from one corner showing a vacuum hold-down device according to an embodiment of the present invention, with the base plate and work plate separated.
Figure 2:
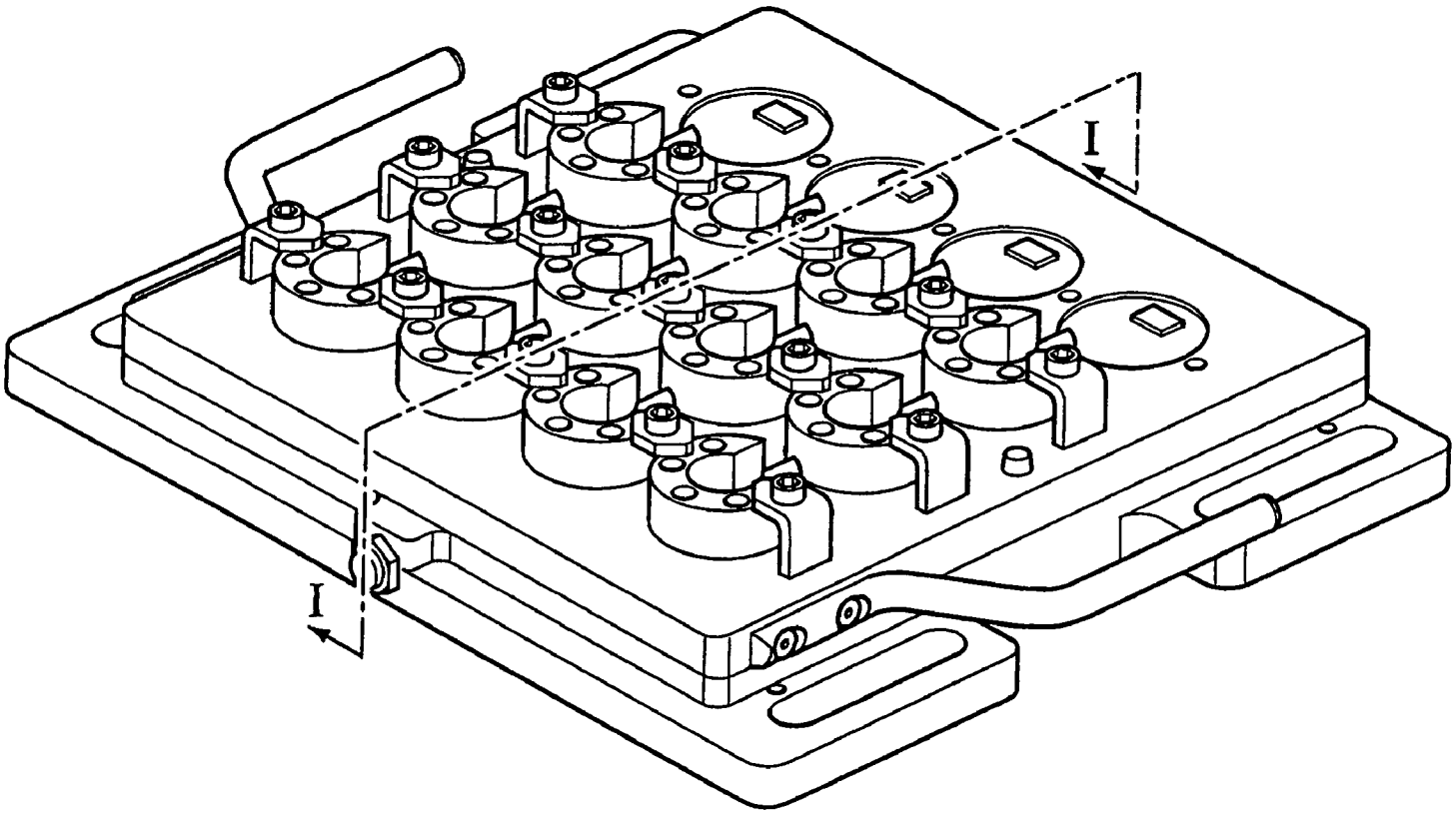
FIG. 2 is a perspective view from an opposite corner of the device of FIG. 1 with the base plate and work plate assembled together.
Figure 3:
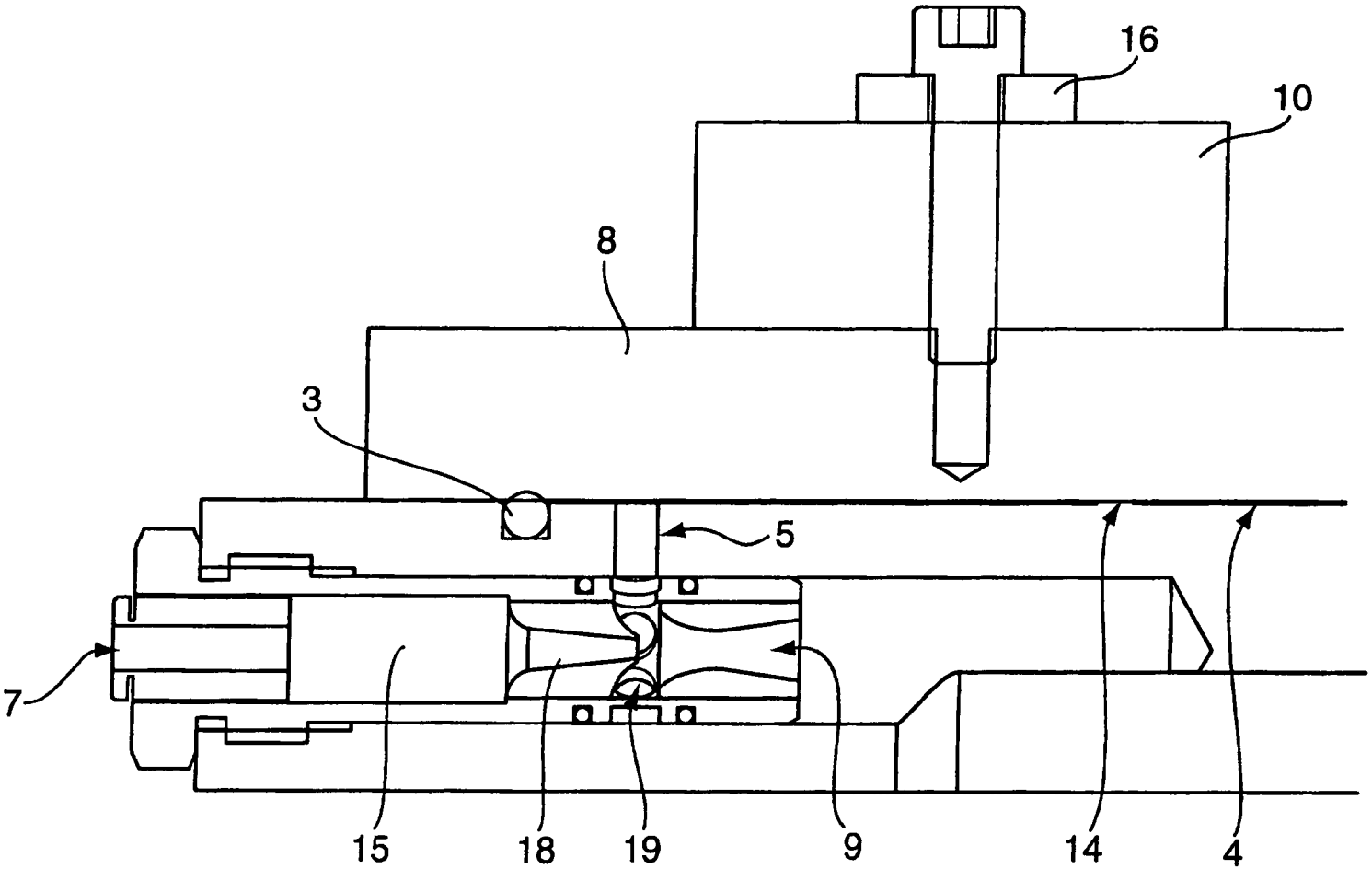
FIG. 3 is a sectional view through part of the device shown in FIG. 2, along the lines I-I.

The vacuum hold-down device shown in FIGS. 1-3 comprises a base plate 1 and a work plate 8 which co-operate to define a vacuum chamber. The base plate 1 is typically formed from a metal, for example steel or aluminium; however other metals may be employed, or structural plastics materials.

The base plate 1 has integral slots 2 formed therein, for clamping it to an existing machine bed or table. Locating dowels 17 permit precise, square location of the base plate on the machine table prior to clamping. The upper surface of base plate 1 has a slightly recessed region 4, surrounded by an O-ring seal 3 for co-operating with the inner (lower) surface of the work plate 8 to define the vacuum chamber. It will be understood that the recessed region could alternatively be provided on the lower surface of the work plate 8, or on both plates. A pair of location dowels 6 are provided on the base plate 1, which fit in corresponding location holes 13 in the workpiece support to ensure correct seating of the workpiece support 8 on the base plate 1. The arrangement of location dowels and location holes could of course be reversed.

The work plate 8 is made of metal and has on its upper (work) surface a number of locations 12 for receiving component workpieces 10 for machining. A component clamp 16 is provided for securing each workpiece 10 to the work surface. A pair of pallet change handles 11 are provided on the work plate 8 to facilitate moving of the work plate.

Referring now to FIG. 3, the base plate incorporates a venturi vacuum generator 15. The venturi 15 has a fluid inlet port 7, in this example for receiving a stream of compressed air. The air flows through a narrowing chamber 18 in the venturi, and may reach a speed in excess of 950 km/h before exiting through an exhaust fluid outlet 9 and passing through a channel in the machine table. A port 19 at the lowest pressure region in the venturi communicates with the inside of the vacuum chamber via a transfer port 5 in the base plate 1. Thus, when pressurized air passes through the venturi 15, it draws air from the vacuum chamber and creates a partial vacuum which holds the work plate 8 firmly in place on the base plate 1. When the vacuum is released, the work plate 8 may be lifted off the base plate 1 and quickly replaced by another work plate 8 loaded with clamped components for machining. Machine downtime is minimised.

Within the recessed region 4 of the base plate 1 are located a series of upstands 14, which are machined to the same plane as the area surrounding the recessed region 4. These provide support to the work plate 8, and give a large parallel clamping face with a high clamping potential. I have calculated that a 500 mm square fixture with a vacuum chamber area of area about 0.2 $m^2$ and depth about 0.2 mm may be acted upon by an effective total force of over 1800 kg depending on the degree of vacuum available from the venturi.

It would be quite possible to mount the venturi externally; but by mounting it within the area of the base plate the volume of vacuum which has to be generated is reduced.

For larger batches, a pair of work plates 8 may be provided. Various components 10 may be loaded onto the free work plate 8 while components 10 on the other work plate 8 are being machined. On completion of the machining process, the work plates may be quickly swapped, thereby minimizing machine down-time.

Figure 4:
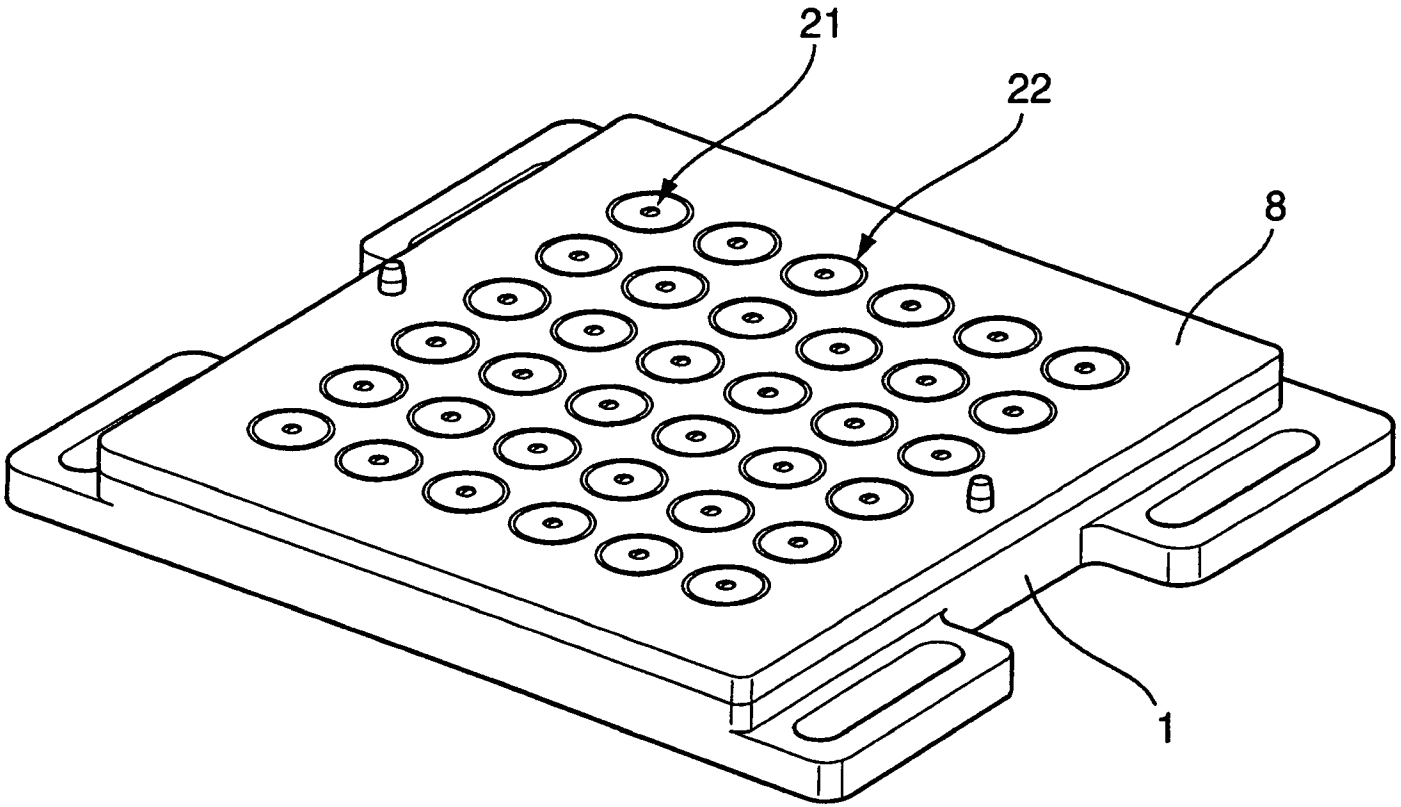
FIG. 4 is a perspective view of a vacuum hold-down device according to another embodiment of the present invention.

Referring now to FIG. 4, the base plate 1 is shown loaded with a universal work plate 8. The plate 8 is provided with an array of holes which connect the upper work surface to the inside of the vacuum chamber. Each hole is surrounded by a sealing O-ring 22 and may be plugged with a vacuum retention screw 21. This work plate can be used for virtually any shaped component to be held by vacuum. The component can be laid onto the universal work plate 8 so that it can be worked out which vacuum retention screws 21 should be removed to allow vacuum clamping in those areas where the component is to be located. The process may comprise laying the component on the work surface; drawing a line around its periphery; removing the component; and removing the vacuum retaining screws 21 within the drawn periphery. The component may then be replaced and the venturi operated.

Figure 5:
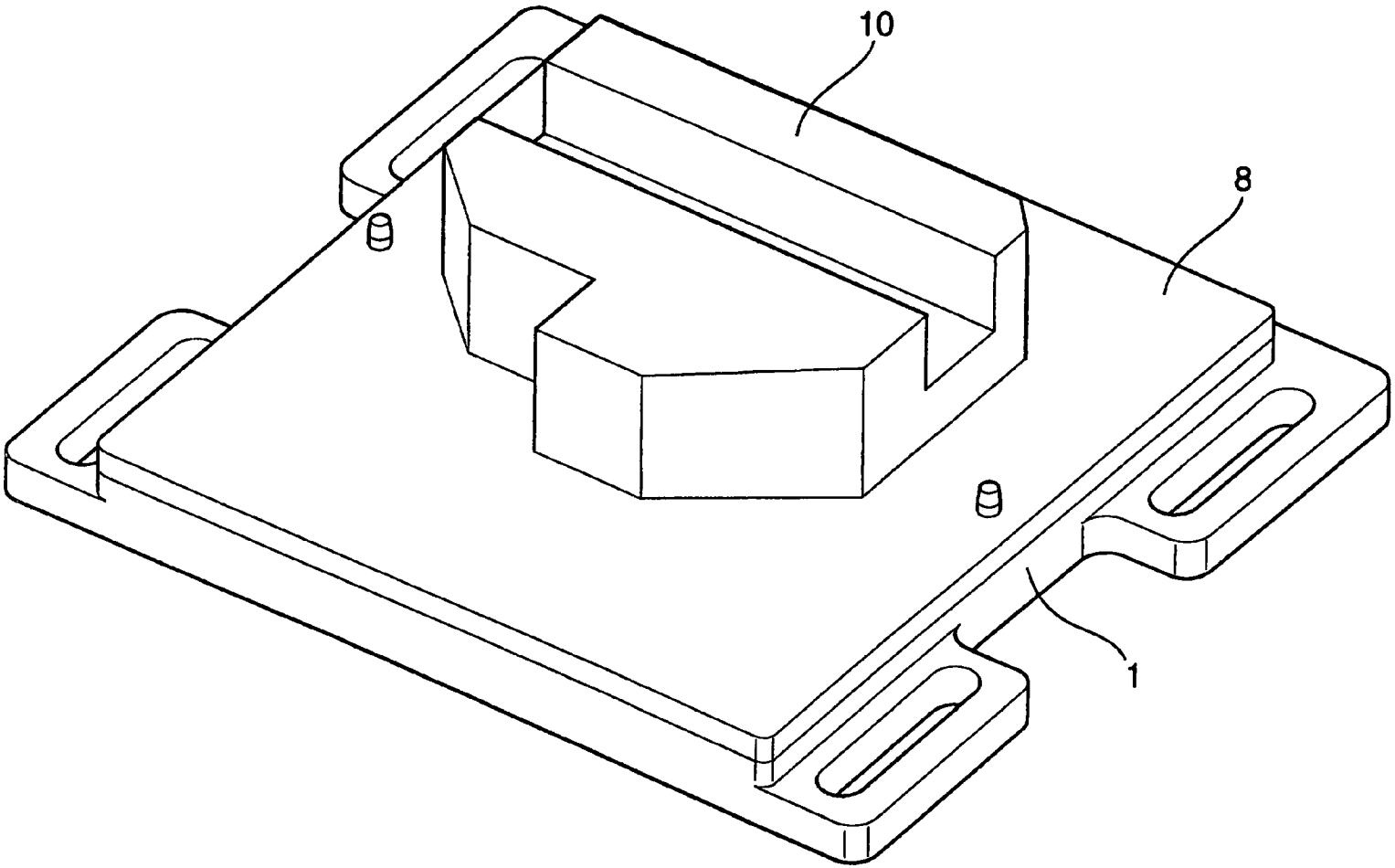
FIG. 5 is a perspective view of a vacuum hold-down device according to a further embodiment of the present invention, with a workpiece on the work plate.

The work plate 8 shown in the embodiment of FIG. 5 is specially adapted for a particular shape of component 10. The base plate 1 is unchanged. A plurality of vacuum hold-down holes may be provided in the work plate, surrounded by sealing O-rings, only in the area where the component 10 is to be located. Alternatively, a single large opening may be provided, surrounded by a sealing ring. The large opening may be shaped to match the periphery of the component and maximize the clamping force. This arrangement is well suited for regularly machined components, to reduce set-up time.

Figure 6:
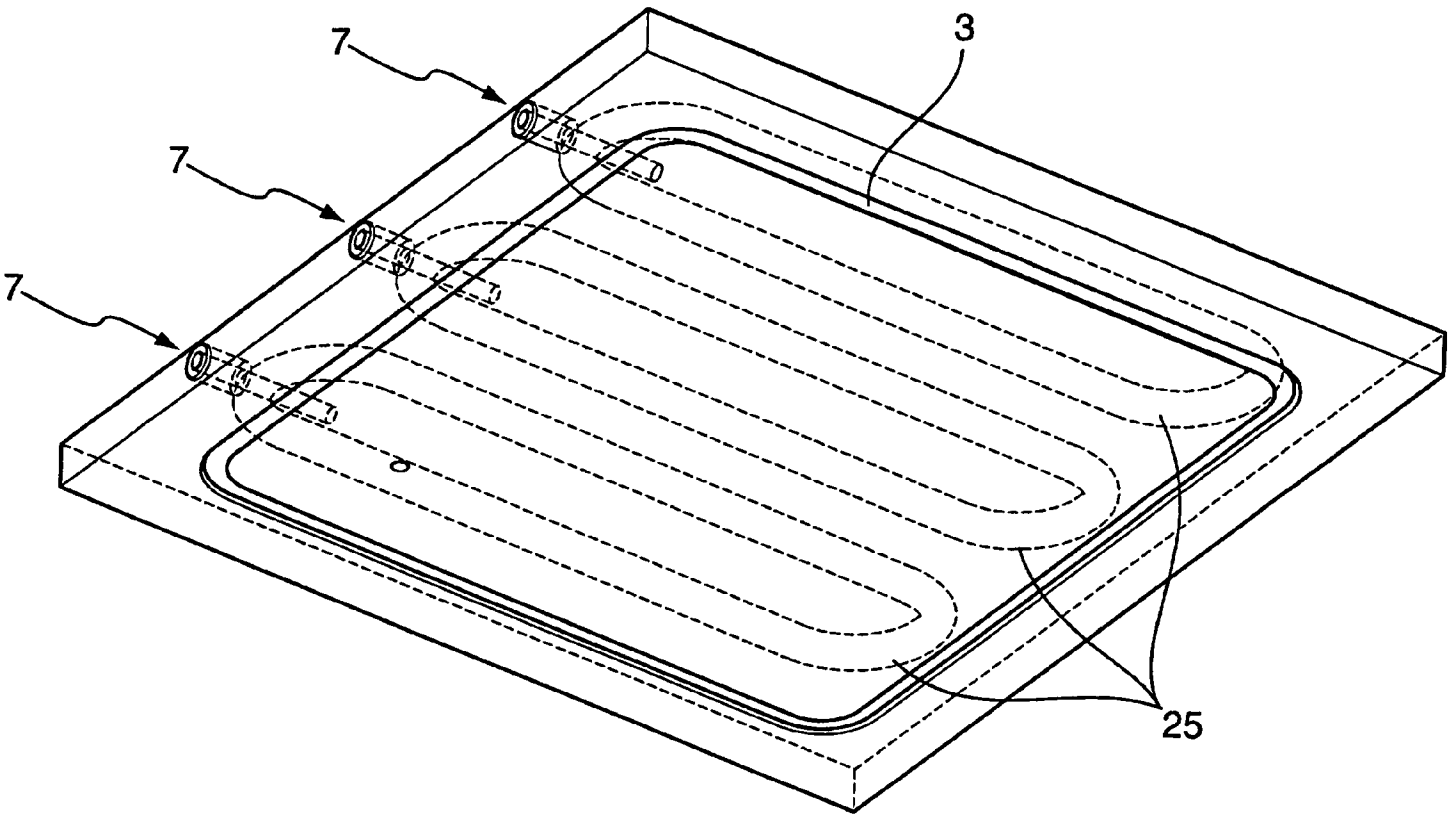
FIG. 6 is a perspective view of a different embodiment of the invention, with hidden parts shown in faint lines.

On larger plates, the vacuum could also be transferred through the base of the base plate 1, as illustrated in FIG. 6. In this embodiment, three venturi intakes 7 are provided, each of which is associated with an O-ring seal 25 in the base of the base plate 1. A single seal 3 is provided in the top of the base plate 1, as previously described. Transferring the vacuum through the lower surface of the base plate aids its clamping to a table. This helps to reduce vibration, and is of particular use when machining the centre of a plate or an area inaccessible to conventional clamping. Although three venturis are used in this embodiment for illustrative purposes, it will be understood that only a single venturi, and a single lower O-ring, or any desired number of either, could be used.

Figure 7:
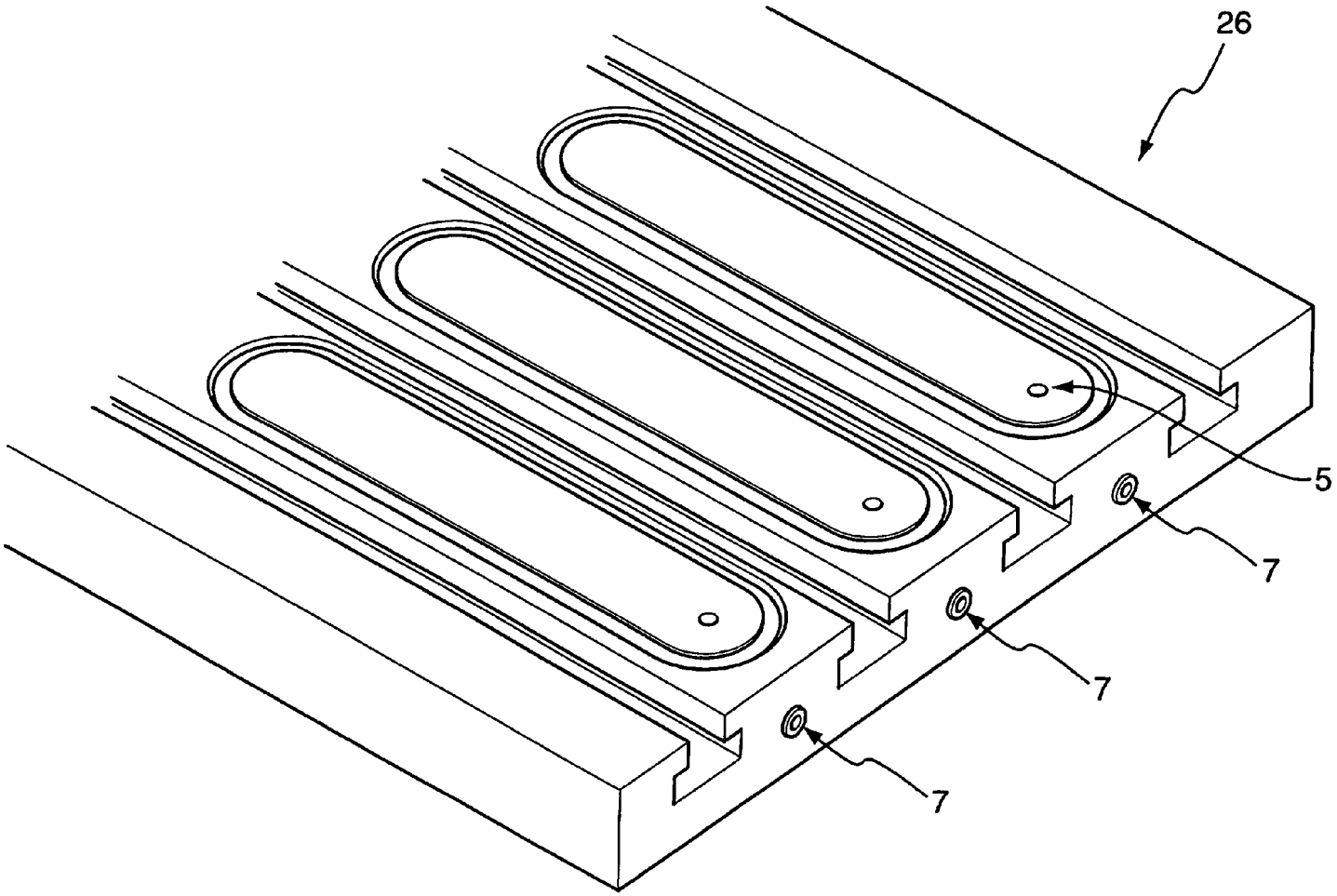
FIGS. 7 to 9 are views of vacuum hold-down devices according to further different embodiments of the invention.

It would be possible to add O-ring seals to a standard table as a retrofit, or to incorporate these in the manufacture of a new table. The rings would enable the use of vacuum hold-down as well as conventional clamping on the one base machine table 26, as illustrated in FIG. 7. The machine could have a flat table with an O-ring about the outer perimeter, optionally with one or more (preferably two) location dowels. To this could be added plates containing all the parts required for machining different components such as jigs or fixtures, or multi-vice setups, with known datum positions in minutes. This embodiment provides cost savings and will also be useful for longer running jobs or those requiring less observation at night and other less labour-intense periods.

Figure 8:
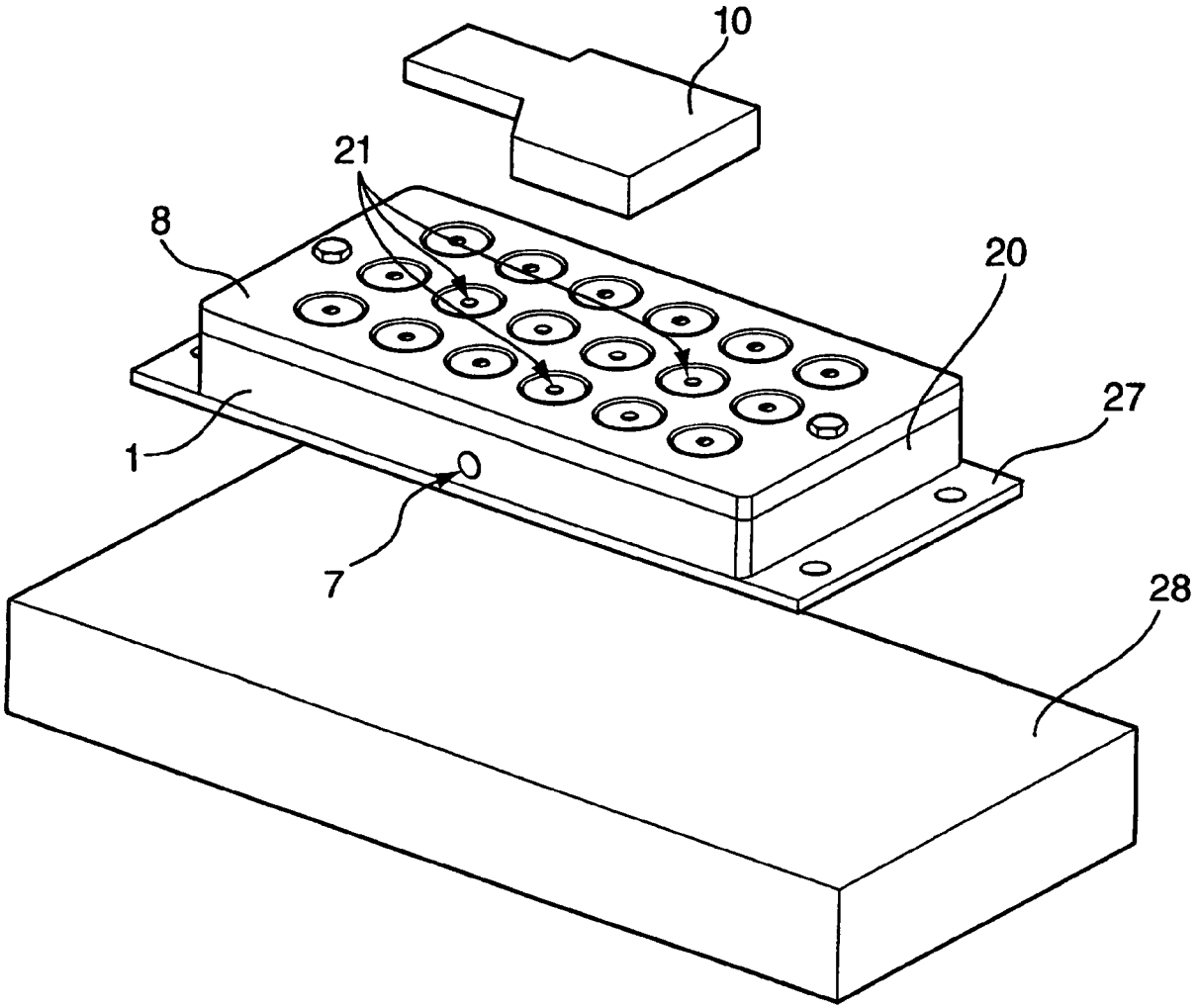

Referring now to FIG. 8, a magnetic chuck 28 is conventionally used for clamping ferromagnetic components. By forming the base plate 1 from a ferromagnetic material such as steel or, as in this embodiment, by providing the base plate 1 with an additional ferromagnetic plate 27 on its base, the base plate 1 may be magnetically clamped to the magnetic chuck 28. This permits the machining of non-ferromagnetic components on the magnetic chuck. In the illustrated embodiment, the base plate 1 and universal work plate 8 act as a vacuum chuck 20. Blanking screws 21 are removed in those areas where the component 10 to be machined is to be located. The steel plate 27 enables quick loading to the magnetic chuck 28. This is particularly useful in grinding machines, but this chuck could be located anywhere, and would even be useful in assembly operations.

Figure 9:
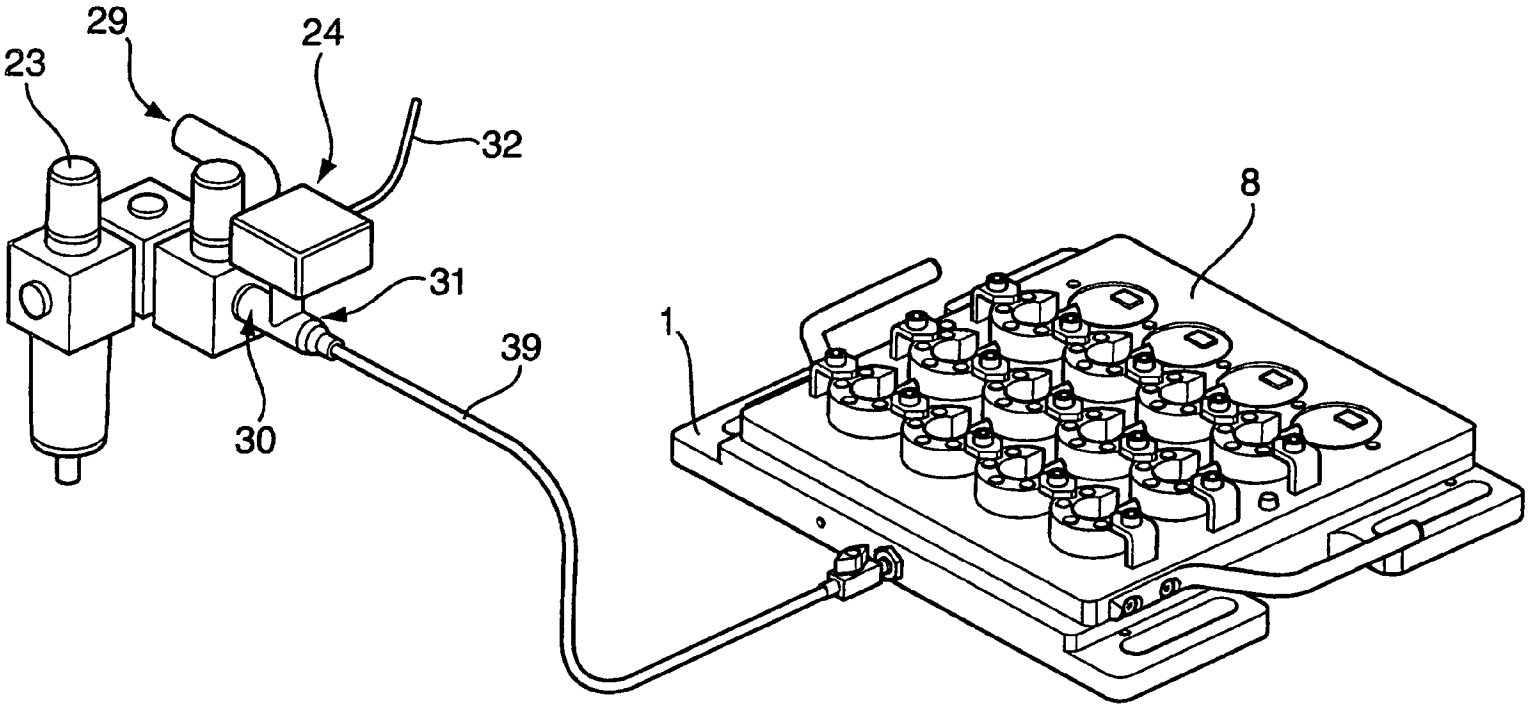
Figure 10:
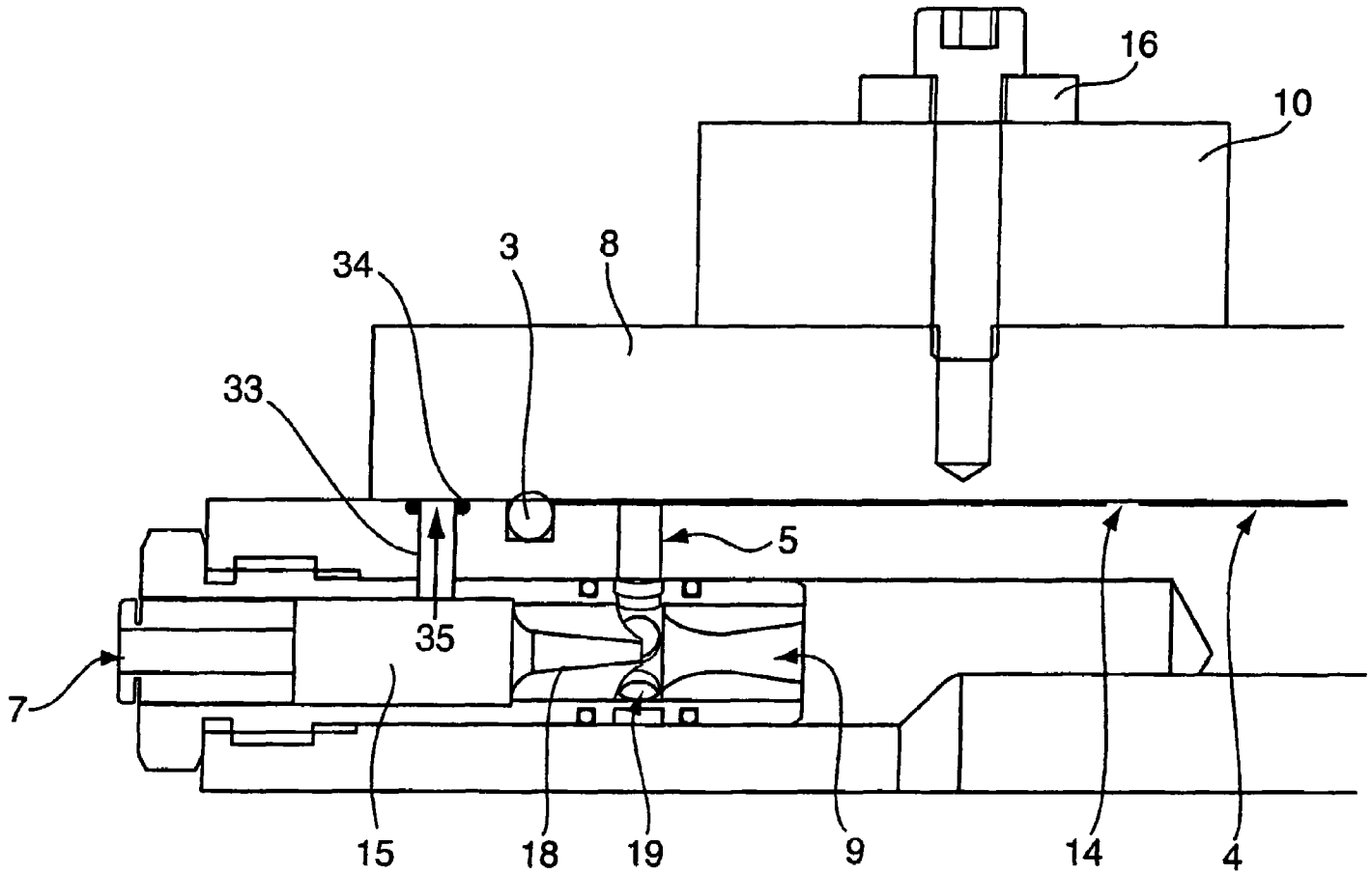
FIG. 10 is a sectional view corresponding to FIG. 3, through part of the device shown in FIG. 9.
Figure 11:
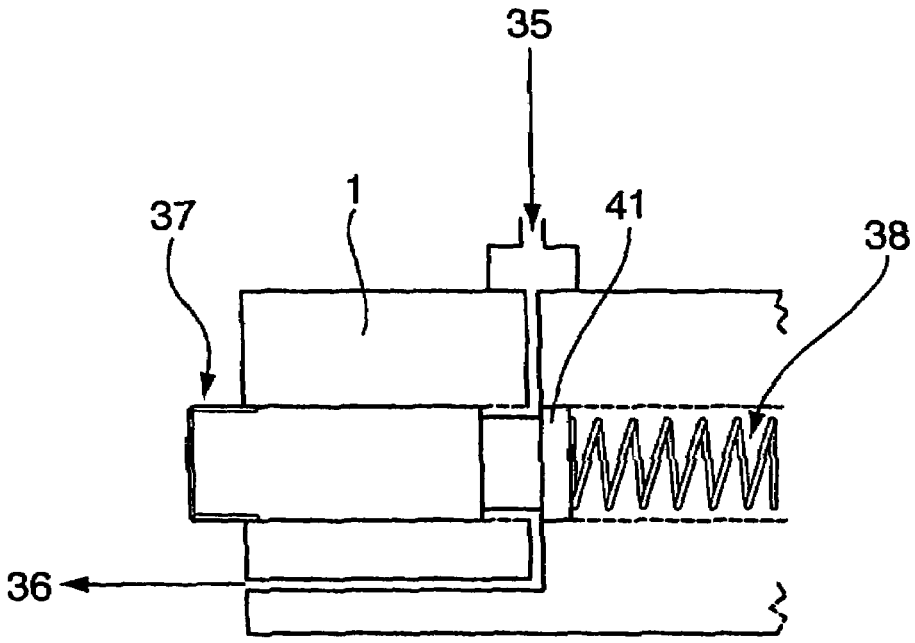
FIGS. 11 and 12 are part sectional views of a pressure release and vacuum indicator feature for use in the embodiment of FIG. 10.
Figure 12:
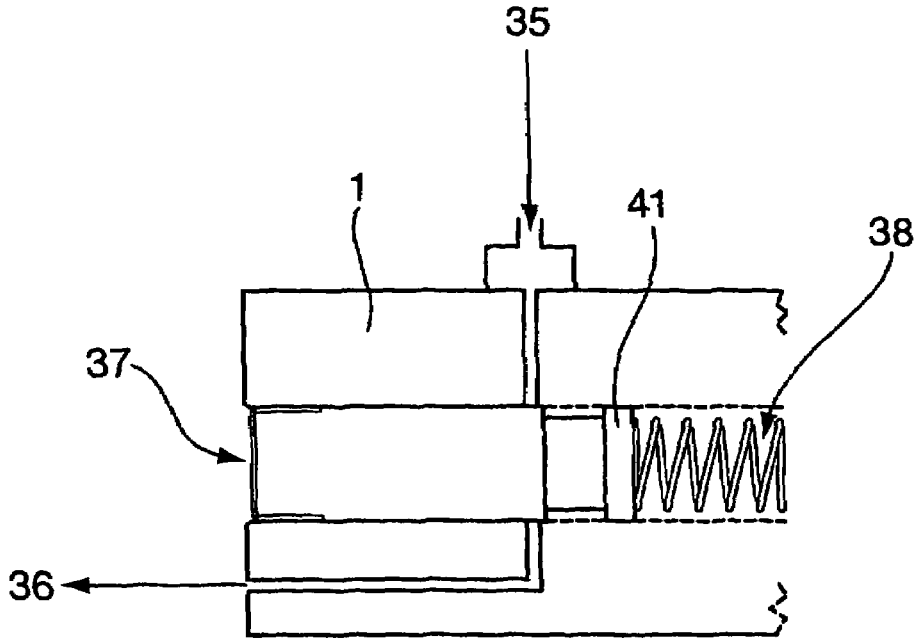

In the arrangement illustrated in FIG. 9, pressurised air is provided to the venturi via a pipe 39 from a pressure regulator 23. The pressure regulator 23 has an air supply inlet 29 and a low pressure switch 24. These components have been provided as standard on the rear of all Computer Numerical Controlled (CNC) machines since about 1990. A small extension piece 31 has been added between the pressure switch 24 and the pressure regulator 23, within which is a small restriction hole 30 (in this embodiment about 1.5 mm diameter). The restriction hole is large enough to run the venturi efficiently. If the pressure switch 24 detects a reduction in pressure below a preset limit, it will trigger a low pressure alarm (not shown) via connector 32, and put the machine in emergency stop mode and stop the machine and spindle from finishing their operation. An arrangement for providing the reduction in pressure to trigger the low pressure switch is illustrated in FIGS. 10-12. Referring to FIG. 10, the venturi 15 has a radial bypass channel 35 with an O-ring seal 34 at the work plate 8. The bypass channel 35 has a larger diameter than the restriction 5 through to the top of the base plate 1. When a component 10 is held in place by vacuum it is ready for machining to take place. If there is a loss of vacuum, air will be able to flow through the bypass channel 33 in the direction of arrow 35. This will cause a large pressure drop at the pressure switch 24.

Referring now to FIGS. 11 and 12, details of a mechanism for opening the bypass channel 33 are illustrated. In FIG. 11 there is a fluid connection between the bypass channel 35 and an air exhaust 36 to atmosphere. The low pressure switch 24 will be triggered. In the path from the bypass channel 35 to the exhaust 36 is provided a vacuum indicator pin 37 which is urged to an unblocking position shown in FIG. 11 by means of a spring 38. The pin 37 projects from the base plate 1 and provides a visible indicator that there is insufficient vacuum for machining to take place. The spring 38 acts on a movable sealing member 41 which makes a substantially fluid-tight seal within the bore in which it is located. The sealing member 41 is connected to or acts on the pin 37. The space behind the spring 38 is connected to the vacuum. When the exposed end of the pin 37 is manually pushed back into the base plate 1, its other end blocks the passage from the bypass channel 35 to the exhaust 36, as shown in FIG. 12. A vacuum is then generated by the venturi, and this vacuum reduces the pressure sufficiently on the spring side of the pin for atmospheric pressure acting on the pin to overcome the spring force and retain the pin 37 in the blocking position shown in FIG. 12. The pin 37 and the sealing member 41 may be integrally or otherwise formed according to manufacturing convenience. This arrangement permits standard parts of machine tools to be used to stop the machine in the event of vacuum failure. Machine costs are reduced and no electrical wiring of the machine to extra pressure sensors is required. The pressure outlet could also be mounted externally of the vacuum fixture in a separate housing, and the release of pressure would be independent of the fixture weight.

Figure 13:
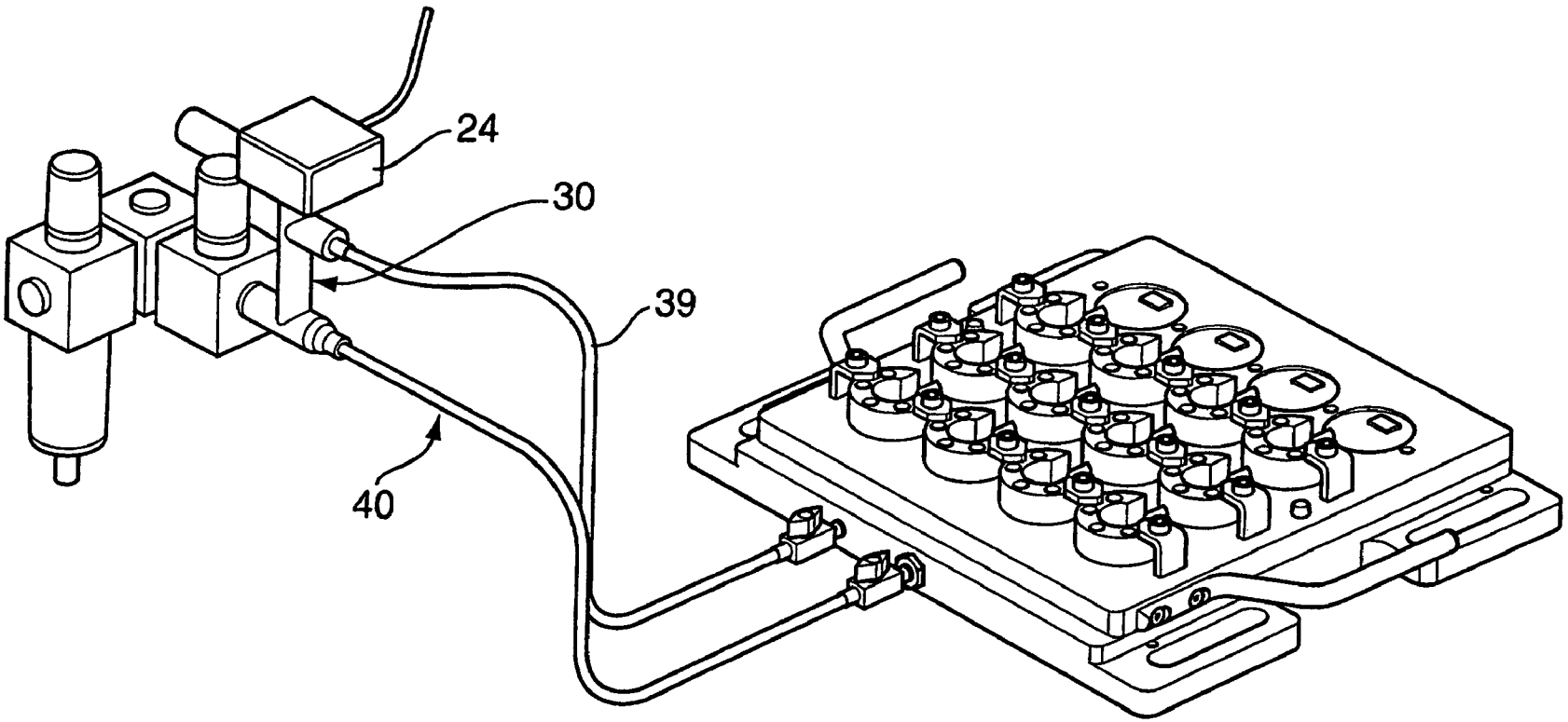
FIG. 13 is a view of a further embodiment in which a plurality of venturi are used.

FIG. 13 illustrates an embodiment in which a plurality of venturi (in this example, two venturi) are used. This embodiment is particularly for use with larger devices which have more air to be evacuated. Here, pipe 39 is connected to a smaller venturi similar to that of the previous embodiments. Pipe 40 is connected to a large venturi and exhausts via a non-return valve. Initially, both venturi are turned on to generate the vacuum. The larger venturi quickly evacuates most of the air, and this is then turned off so that the non-return valve holds the vacuum. The smaller venturi remains working to maintain the vacuum and retain the workpieces. Any number of venturi could be used in this manner. A number of venturi could also be linked to separate chambers to create a plurality of vacuum pockets.

Where the larger venturi has a higher evacuation rate and thus lower pressure, it would be possible to use the pressure differential to activate a non-return valve automatically. The air flow to the venturi could therefore be turned off manually or automatically.

It is appreciated that certain features of the invention, which are for clarity described in the context of separate embodiments, may also be provided in combination in a single embodiment. Conversely, various features of the invention which are, for the sake of brevity, described in the context of a single embodiment, may also be provided separately or in any suitable subcombination.

The terms 'rise' and 'fall' in the level of vacuum are used herein to refer to, respectively, a decrease and an increase in pressure.

The indefinite articles 'a' and 'an' are used herein to mean "one or more" unless the context otherwise dictates.

While the present invention has been described with reference to specific embodiments, it should be understood that modifications and variations of the invention may be constructed without departing from the scope of the invention defined in the following claims.

The invention claimed is:

1. A vacuum hold-down device comprising a base member having a vacuum chamber including a venturi having an inlet port for connection to a source of pressurized fluid, an outlet for fluid from the venturi, and a fluid connection from a low pressure region of the venturi to the inside the vacuum chamber; and a separate workpiece support with a securing means which is removably attached to the base in order to maintain a peripheral seal thereon.

2. A device according to claim 1, further including a bypass channel which connects a location between the inlet port and the low pressure region of the venturi to an air exhaust port for venting air to atmosphere, and a mechanism for automatically opening said channel in the event that vacuum in the vacuum chamber falls below a predetermined level.

3. A device according to claim 2, wherein said mechanism is arranged to automatically close said bypass channel when vacuum in the vacuum chamber rises above a predetermined level.

4. A device according to claim 2, wherein said mechanism comprises a blocking member movable between a blocking position in which it blocks the bypass channel and an unblocking position in which it does not block the bypass channel; said blocking member being urged by a spring force to the unblocking position when vacuum in the vacuum chamber falls below a predetermined level.

5. A device according to claim 4, wherein the blocking member is connected to or integrally formed with a sealing member which provides a substantially fluid-tight seal between the bypass channel and the vacuum chamber, whereby, when a sufficiently high vacuum is applied in the vacuum chamber the sealing member is urged by atmospheric pressure in a direction to move the blocking member from the unblocking position to the blocking position or to maintain the blocking member in the blocking position against the spring force.

6. A device according to claim 4, wherein when the blocking member is in the unblocking position part of said blocking member projects outside the base member to provide a visible indication that the vacuum level is insufficient.

7. A device according to claim 1, further including a source of pressurized fluid connected to the inlet port and provided with a pressure switch which will trigger a signal in the event that the fluid pressure drops below a predetermined value.

8. A device according to claim 1, wherein said fluid connection to the inside of the vacuum chamber is via a port in the base member.

9. A device according to claim 1, wherein the vacuum chamber is provided with at least one internal support that spans the distance between major internal surfaces of the base member and the workpiece support.

10. A device according to claim 9, wherein said at least one internal support comprises a plurality of elongate parallel upstands provided on the base member.

11. A device according to claim 1, wherein said securing means comprises at least one mechanical clamp for securing a workpiece.

12. A device according to claim 1, wherein said securing means comprises at least one hole in the workpiece support, providing fluid communication between the inside of the vacuum chamber and the work surface on top of the workpiece support to which a workpiece is to be secured.

13. A device according to claim 12, wherein at least one hole is provided in the base member, providing fluid communication between the inside of the lacuum chamber and an outside surface of the base member, to enable vacuum hold-down of he base member on a supporting surface.

14. A device according to claim 1, wherein the venturi is lisposed substantially within the base member.

15. A device according to claim 1, wherein the base member is part of a machine table.

16. A vacuum hold-down device system comprising a base member having a vacuum chamber including a venturi having an inlet port for connection to a source of pressurized fluid, an outlet for fluid from the venturi, and a fluid connection from a low pressure region of the venturi to the inside the vacuum chamber; and a plurality of workpiece supports with a securing means which are interchangeably removably attached to the base in order to maintain a peripheral seal thereon.

17. The vacuum hold down system according to claim 16, wherein said securing means comprises at least one mechanical clamp for securing a workpiece.

18. The vacuum hold down system according to claim 16, wherein each of said workpiece supports is of substantially identical.

19. The vacuum hold down system according to claim 16, wherein at least one of said workpiece supports includes a handle.

20. The vacuum hold down system according to claim 16, wherein the venturi is disposed substantially entirely within the area of the base member.

21. The vacuum hold down system according to claim 16, wherein at least one hole is provided in the base member, providing fluid communication between the inside of the vacuum chamber and an outside surface of the base member.

22. The vacuum hold down system according to claim 16, further including a bypass channel which connects a location between the inlet port and the low pressure region of the venturi to an air exhaust port for venting air to atmosphere, and a mechanism for automatically opening said channel in the event that vacuum in the vacuum chamber falls below a predetermined level.

23. The vacuum hold down system according to claim 22, wherein said mechanism comprises a blocking member movable between a blocking position in which said blocking member blocks the bypass channel and an unblocking position in which said blocking member does not block the bypass channel; said blocking member being urged by spring means to the unblocking position when vacuum in the vacuum chamber falls below a predetermined level.

24. The vacuum hold down system according to claim 23, wherein the blocking member is connected to or integrally formed with a sealing member which provides a substantially fluid-tight seal between the bypass channel and the vacuum chamber, whereby when a sufficiently high vacuum is applied in the vacuum chamber the sealing member is urged by atmospheric pressure in a direction to move the blocking member from the unblocking position to the blocking position or to maintain the blocking member in the blocking position against the spring force.

25. The vacuum hold down system according to claim 23, wherein when the blocking member is in the unblocking position part of said blocking member projects outside the base member to provide a visible indication that the vacuum level is insufficient.

26. The vacuum hold down system according to claim 16, further including a source of pressurised fluid connected to the inlet port and provided with a pressure switch which will trigger a signal in the event that the fluid pressure drops below a predetermined value.

27. The vacuum hold down system according to claim 16, wherein at least one of said workpiece supports includes an o-ring seal.

28. The vacuum hold down system according to claim 27, wherein at least one of said workpiece supports with said an o-ring seal further comprising a locating hole wherein base plate further comprises corresponding location pins.

* * * * *